US006357332B1

(12) United States Patent
Vecchio

(10) Patent No.: US 6,357,332 B1
(45) Date of Patent: Mar. 19, 2002

(54) PROCESS FOR MAKING METALLIC/ INTERMETALLIC COMPOSITE LAMINATE MATERIAN AND MATERIALS SO PRODUCED ESPECIALLY FOR USE IN LIGHTWEIGHT ARMOR

(75) Inventor: Kenneth Vecchio, San Diego, CA (US)

(73) Assignee: Thew Regents of the University of California, Oakland, CA (US)

( * ) Notice: Subject to any disclaimer, the term of this patent is extended or adjusted under 35 U.S.C. 154(b) by 0 days.

(21) Appl. No.: 09/130,722

(22) Filed: Aug. 6, 1998

(51) Int. Cl.[7] ..... F41H 5/04
(52) U.S. Cl. ..... 89/36.02; 428/911
(58) Field of Search ..... 89/36.02; 428/911; 109/49.5

(56) References Cited

U.S. PATENT DOCUMENTS 3,592,147 A * 7/1971 Harper ..... 109/80
4,911,990 A * 3/1990 Prewo et al. ..... 428/554
5,260,137 A * 11/1993 Rosenthal et al. ..... 428/608

* cited by examiner

*Primary Examiner*—Stephen M. Johnson
(74) *Attorney, Agent, or Firm*—Fuess & Davidenas

(57) ABSTRACT

Typically 20–40 films of a tough first metal, normally 0.1–1.0 mm thick films of titanium, nickel, vanadium, and/or steel (iron) and alloys thereof, interleaved with a like number of films of a second metal, normally 0.1–1.0 mm thick films of aluminum or alloys thereof, are pressed together in a stack at less than 6 MPa and normally at various pressures 2–4 MPa while being gradually heated in the presence of atmospheric gases to 600–800° C. over a period of, typically, 10+ hours until the second metal is completely compounded; forming thus a metallic-intermetallic laminate composite material having (i) tough first-metal layers separated by (ii) hard, Vickers microhardness of 400 kg/mm$^2$+, intermetallic regions consisting of an intermetallic compound of the first and the second metals. The resulting composite material is inexpensive, lightweight with a density of typically 3 to 4.5 grams/cubic centimeter, and very hard and very tough to serve as, among other applications, lightweight armor. Upon projectile impact (i) the hard intermetallic, ceramic-like, layers are confined by the tough metal layers while (ii) cracking and fracturing is blunted and channeled in directions orthogonal to the axis of impact.

29 Claims, 6 Drawing Sheets

FIG. 4
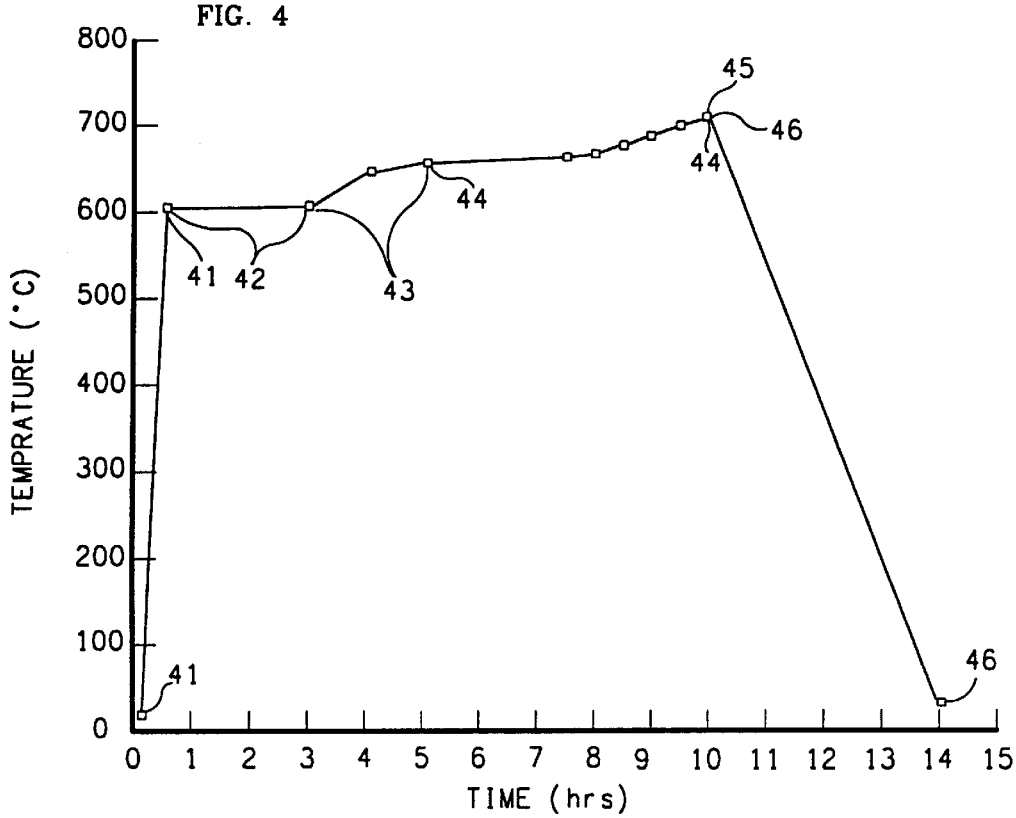
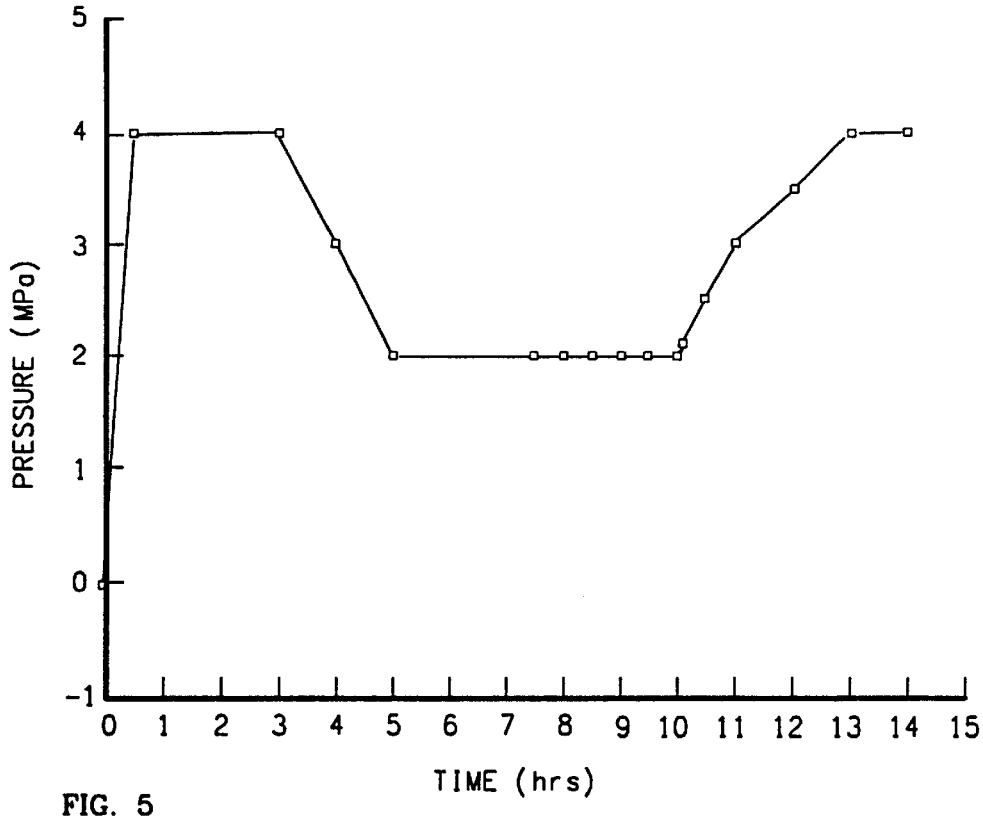
FIG. 5

Table 1. Typical values of plane strain fracture toughness, $K_{IC}$, at room temperature (for illustration purposes only)

| MATERIALS | E (GPa) | $\sigma_y$ (MPa) | $K_{IC}$(MPa) | $r_{IC}$(mm) | L (mm) |
|---|---|---|---|---|---|
| **Steels** | | | | | |
| Medium carbon (AISI-1045) | 210 | 269 | 50 | 55 | 88.0 |
| Pressure Vessel (ASTM-A5330-B) | 210 | 483 | 153 | 16.0 | 256.0 |
| High Strength Alloy (AISI-4340) | 210 | 1,593 | 75 | 0.4 | 6.4 |
| Maraging Steel (250-Grade) | 210 | 1,786 | 74 | 0.3 | 4.8 |
| **Aluminum Alloys** | | | | | |
| 2024-T4 | 72 | 330 | 34 | 1.7 | 27.2 |
| 7075-T651 | 72 | 503 | 27 | 0.5 | 8.0 |
| 7039-T651 | 72 | 338 | 32 | 1.4 | 22.4 |
| **Titanium Alloys** | | | | | |
| Ti-6AL-4V | 108 | 1,020 | 50 | 0.4 | 6.4 |
| Ti-4Al-4Mo-2Sn-05 Si | 108 | 945 | 72 | 0.9 | 14.4 |
| Ti-6Al-2Sn-4Zr-6Mo | 108 | 1,150 | 23 | 0.1 | 1.6 |
| **Polymers** | | | | | |
| PS | 3.25 | | 0.6 - 2.3 | | |
| PMMA | 3. - 4. | | 1.2 - 1.7 | | |
| PC | 2.35 | | 2.5 - 3.8 | | |
| PVC | 2.5 - 3. | | 1.9 - 2.5 | | |
| PETP | 3 | | 3.8 - 6.1 | | |
| **Ceramics** | | | | | |
| Si3N4 | | | | | |
| SiC | 410 | | 43-45 | | |
| Al203 | | | | | |
| Soda-Lime Glass | 350 | | 30-75 | | |
| WC - 15 wt% Co (cermet) | 570 | | 16. - 18. | | |
| Electrical Porcelain | - | | 1. | | |

Figure 6
PRIOR ART

TABLE 2

KNOOP MICROHARDNESS DATA FOR NICKEL AND NICKEL INTERMETALLIC PHASES FOR HOT-PRESSED Ni-Al DISKS AND TITANIUM AND TITANIUM INTERMETALLIC PHASES FOR HOT-PRESSED Ti-Al DISKS

(25 g load)

| Phase | $H_{H25}$ (kg/mm$^2$) |
|---|---|
| Ni | 135 |
| Ni(Al) | 170 |
| $Ni_3Al$ | 424 |
| NiAl | 450 |
| Ti | 150 |
| Ti(Al) | 300 |
| $Ti_3Al$ | 420 |
| TiAl | 590 |
| $TiAl_3$ | 700 |

Figure 7
PRIOR ART

FIG. 8a
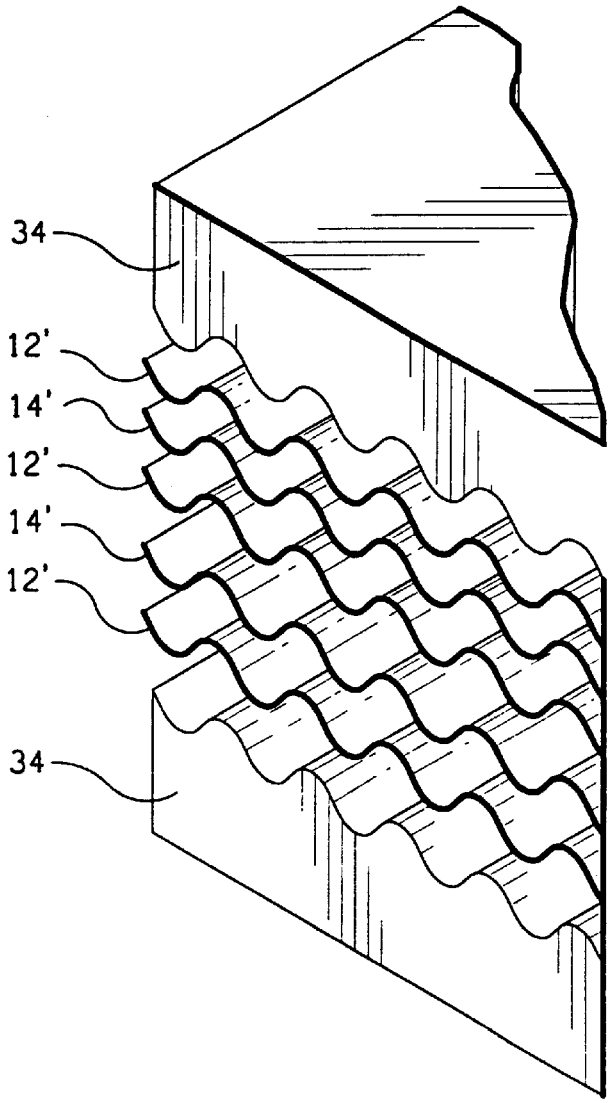
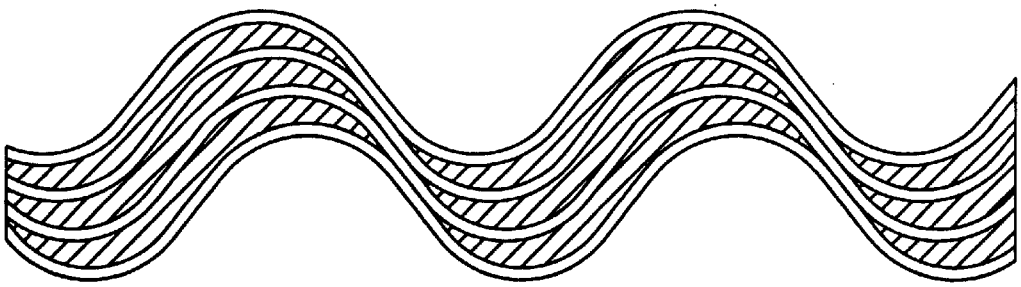
FIG. 8b

PROCESS FOR MAKING METALLIC/ INTERMETALLIC COMPOSITE LAMINATE MATERIAN AND MATERIALS SO PRODUCED ESPECIALLY FOR USE IN LIGHTWEIGHT ARMOR

This invention was made by support of the U.S. Government under Contract No. ARO MURIADAAHO-4-96-1-0376 acting through the United States Army Research Office. The U.S. Government has certain rights in this invention.

BACKGROUND OF THE INVENTION

1. Field of the Invention

The present invention generally concerns (i) processes for making composite laminate materials from multiple sheets of thin metals; (ii) laminate composite materials so made; and (iii) uses of the laminate composite materials so made, particularly in lightweight armor.

The present invention particularly concerns (i) processes for making in air in a heated load press composite laminate materials at large size and low cost, including in contoured form; (ii) composite laminate materials having large numbers of (a) tough metal layers interleaved with (b) hard intermetallic regions; and (iii) the tailoring of hard composite laminate materials for use, among other applications, as lightweight vehicular and body hard armor.

2. Description of the Prior Art 2.1 Armor

The following discussion, and facts, are presently, circa 1998, available at many sites on the Internet. The following materials of this section 2.1 are in particular derived from information available, circa 1998, at the web site of Armor Technology Corporation, www.armortechnology.com.

2.1.1 Armor

Armor is a protective 'skin', or plating for protection of an underlying structure. There are basically three types of armor. Homogenous armor has the same hardness throughout. Face-hardened armor has an extremely hard outer layer while the rest is hard, but less brittle. Laminated armor is made up of several hard layers of material, such as steel, titanium, ceramics, etc.

Tanks and other military vehicles use abundant armor. Armor is also used in armored land combat vehicles, structural shields, load bearing security walls, armored cars and other commercial vehicles, high speed trains, cash carrying vehicles (especially as all-around protection); private cars (most usually in door and floor panels); financial institutions particularly in security doors, partitions and briefcases; private homes particularly in front doors, walls and partitions; helicopters and light aircraft particularly in seats, doors, panels, channels; and boats and small ships particularly in superstructures, cabins and control rooms.

Composite armors are efficient structural materials that also provide outstanding protection against ballistic projectiles. They were originally developed for military armored vehicles to eliminate the need for parasitic armor.

2.1.1 Background of Body Armor

The rationale for body armor is well established. As well as its obvious application in warfare, every year about 60 sworn police officers are shot to death in the United States in the line of duty. At the same time, about 20 are saved by wearing armor. Had all the officers shot in recent years been wearing armor when shot, another 15 per year would likely have been saved from fatal gunshot wounds, roughly doubling the present number saved, and more than 15 others would likely have been saved from death by other causes.

Most police officers serving large jurisdictions report they have armor and wear it at all times when on duty and clearly identifiable as police officers. The kind of armor usually worn is soft armor, which is designed to be concealable—most styles are undergarments—and comfortable enough to be worn routinely. Such armor is designed for protection from handgun bullets but not from rifle bullets or edged or pointed weapons such as knives or icepicks. The distinctive, nonconcealable "tactical" armor worn by police SWAT (Special Weapons and Tactics) teams for protection from rifle bullets as well as pistol bullets is more familiar to many laymen. This latter type of "hard" personal armor is the type of armor supported by the advanced materials of the present invention, which are very lightweight but rigid.

Lightweight, composite, body armor preferably protects effectively against not only most known small-arms, as at present, but also against high velocity ballistic threats. Optional plate inserts presently provide some extra level of protection against rifle bullets, but are not presently of practical size and weight for extended wear.

A comfortable, ergonomic, body armor product would preferably accord the wearer maximum comfort even during prolonged periods of wear. At least front and back protection should be provided. The armor garment would desirably not contribute to heat stress of the wearer, but would readily accommodate physical effort by the wearer.

2.1.2 Summary of NIJ Standard 0101.03

The National Institute of Justice (NIJ) standard 0101.03 is of relevance to the present invention because, as will be explained, the materials of the invention are readily used in construction of, among diverse other forms of armor, "hard" body armor. The body armor so constructed, although lightweight at about 3.0 to 4.5 grams per cubic centimeter, is potentially capable of meeting NIJ standard 0101.03 type IV, as explained below. It is the first practical body armor of both such (i) thinness and (ii) light weight known to the inventors to potentially so meet this standard. For example, it will be found in this specification disclosure that the 0.2 inch thickness of the new material has reliably stopped high-power penetrating rounds (of the types explained below) that will penetrate ¾" of hard steel armor, which steel armor is, of course, also much more dense.

The National Institute of Justice (NIJ) standard 0101.03 is a performance standard, not a construction standard. It does not specify the area of coverage, nor does it specify any material to be used in the armor. The standard is thus directed to permitting and encouraging technical innovation, including the development of materials and designs providing better ballistic resistance, greater comfort, or lower cost. However, some aspects of the standard were introduced specifically to provide stringent tests of likely weak points of Kevlar fabric armor, which at the time was almost the only type of concealable body armor marketed in the United States.

NIJ notes that "For the purposes of the . . . body armor certification procedures, the following definitions have been adopted:

A body armor MODEL is a manufacturer designation that identifies a unique ballistic panel construction; i.e., a specific number of layers of one or more types of ballistic fabric and or ballistic-resistant material assembled in a specific manner.

A body armor STYLE is a manufacturer designation (number, name, or other descriptive caption) used to distinguish between different configurations of a body armor product line each of which includes the same model of ballistic panel.

The 0.03 standard defines six standard types of ballistic resistance for which armor may be tested and provides for custom testing for "special type" ballistic resistance. Each type is defined in terms of the type or types of bullets fired at panels of the armor to test its ballistic resistance (see table 1, following). Two types of handgun bullets are fired to test for Type I, II-A, II, or III-A ballistic resistance, which soft armor can provide. One type of rifle bullet is fired to test for Type III or IV ballistic resistance, which hard armor can provide.

Each standard type of armor is expected to offer protection against the threat associated with it as well as against the threats associated with all other standard types of armor appearing above it in table 1. For this reason, the types of armor defined by NIJ Std.-0101.03 are often referred to as "levels," level II-A being presumably superior to level I, for example. However, a certification test for type II-A ballistic resistance would not actually test resistance to type I threats. In addition, an NIJ guide specifies other threats against which it expects armor of each standard ballistic-resistance level to provide protection (see table 2), even though the 0.03 test does not actually test resistance to such threats.

TABLE 1

Types of Ballistic Resistance Defined by NIJ Standard 0101.03 in Terms of Bullets and Velocities Specified for Testing

| Type | Bullet caliber and type | Bullet mass (grains) | Impact velocity[1] (ft/s) |
|---|---|---|---|
| I | .22 long rifle high-velocity | 40 | 1,050 |
| | .38 round-nose lead | 158 | 850 |
| II-A | .357 jacketed soft-point | 158 | 1,250 |
| | 9-mm full metal jacket | 124 | 1,090 |
| II | .357 jacketed soft-point | 158 | 1,395 |
| | 9-mm full metal jacket | 124 | 1,175 |
| III-A | .44 magnum lead semi-wad cutter gas-checked | 240 | 1,400 |
| | 9-mm full metal jacket | 124 | 1,400 |
| III | 7.62 mm full metal jacket | 150 | 2,750 |
| IV | .30–06 armor-piercing | 166 | 2,850 |
| Special | custom | custom | custom |

[1]Minimum velocity; the maximum velocity for a fair hit is 50 ft/s greater.

SOURCE: National Institute of Justice, 1987.

TABLE 2

Types of Ballistic Resistance Defined by NIJ Standard 0101.03 in Terms of Guns and Ammunition Against Which Protection is Expected

| Type | Threat |
|---|---|
| I | .22, .25, and .32 caliber handguns, .38 Special lead round-nose |
| II-A | .38 Special high-velocity, .45's, low-velocity .357 Magnum & 9-mm, .22 rifles |
| II | Higher velocity .357 Magnum and 9-mm |
| III-A | .44 Magnum and submachine gun 9-mm |
| III | High-power rifle: 5.56 mm, 7.62 mm FMJ, .30 carbine, .30–06 pointed soft point, 12-gauge rifled slug |
| IV | Armor-piercing rifle bullet, .30 caliber (1 shot only). |

SOURCE: National Institute of Justice, 1987 [144] and 1989 [145].

The NIJ standard specifies that "Four complete armors, selected at random and sized to fit a 117 cm (46 in) to 122 cm (48 in) chest circumference, shall constitute a test sample. (Note: The larger the size, the more likelihood that all ballistic testing will fit on just two complete armors.) In quality assurance, "selected at random" usually means "selected at random with uniform probability"—i.e., sampling should ensure that all units of the model should have the same chance of being selected to be tested. However, this is impossible if samples are selected for certification testing before production of the model has been discontinued. Typically samples are selected after only a few units have been produced; consequently, the sampling procedure does not guarantee that the samples are representative of yet-to-be-produced units of the model, particularly of smaller sizes.

Armor to be tested is mounted on a flat block of inelastic backing material—typically modeling clay—to be shot. The impact velocity of each bullet is measured using a ballistic chronograph. If the bullet hits an appropriate point on the panel at an impact velocity within specified limits (see table 1), then the impact is considered a fair hit. The test requires a fair hit in each of six specified areas on each panel in a specified sequence (see the diagrammatic representation in the next following paragraph). Each shot must impact at least 3 inches from the edge of the panel and at least 2 inches from the closest point of impact of any prior shot.

The sequence of aim points on each panel, as specified in NIJ Standard 0101.03, looks like the following diagrammatic representation.

| | | | | |
|---|---|---|---|---|
| | | * #1 | | |
| | #4 * | * #6 | * #5 | |
| #2* | | | | * #3 |

All shots must be at least 7.6 cm (3 in) from any edge and at least 5 cm (2 in) from another shot. The source for this information is the National Institute of Justice, 1987.

In tests of Type I, II-A, II, or III-A ballistic resistance, four complete armors, typically including eight armor panels (four each front and back) are usually shot. Each ballistic element (front or back panel) is sprayed with water and then shot with test bullets of the first type, then another one is sprayed and shot with test bullets of the second type. This is repeated with un-sprayed, dry samples. This requires a minimum of 48 shots per test: 2 element types (front and back)×6 shots each×2 types of bullets×2 wetness conditions.

If the velocity of a shot is too low and it does not penetrate the panel, or if the velocity of a shot is too high and it does penetrate the panel, then the shot is repeated, aimed at least 2 inches from the closest point of impact of any prior shot. However, in more than eight shots (of one caliber) may be fired at any panel. The armor cannot be certified if any fair shot penetrates.

After the first fair shot at each panel, the panel is removed from the backing and the depth of the crater (called the backface signature or BFS) is measured. If the BFS exceeds 44 mm or if the armor was penetrated, it fails; if not, the panel is replaced on the backing without filling the crater or otherwise reconditioning the backing material, and testing for penetration is resumed. (10) The standard prohibits adjusting the panel (e.g., patting it down) thereafter, unless it is reused for testing with a second type of bullet.

2.2 Specific Previous Materials

Certain previous materials relevant to the present invention are discussed in the following sections. The section headings are for convenience only, and the materials described within the section may be relevant to the present invention in any of the manner of fabrication, the existence of intermetallic regions, the particular metals used and/or compounded, and/or other factors not clearly delimited in the section headings. A greater appreciation of the diverse, but generally remote, relevance of the following references to the present invention may potentially be gained if the present invention is first understood, and the following references and previous materials only then considered (reconsidered).

2.2.1. Aluminum, Titanium, and Steel; and Aluminum, Titanium, Titanium-Aluminum or Steel Intermetallics The present invention will be found to concern a hard intermetallic compound preferably having as one of its constituent components aluminum. If is known in metallurgy that intermetallic compounds of aluminum, a relatively soft metal, can be hard.

There are many ways to derive intermetallic compounds. For example, U.S. Pat. No. 5,098,469 to Rezhets issued Mar. 24, 1992 for a POWDER METAL PROCESS FOR PRODUCING MULTIPHASE NI—AL—TI INTERMETALLIC ALLOYS and assigned to General Motors Corporation (Detroit, Mich.) concerns a powder metallurgy process for producing near-net shape, near-theoretical density structures of multiphase nickel, aluminum and/or titanium intermetallic alloys. The process employs pressureless sintering techniques, and consists of blending a brittle aluminide master alloy powder with ductile nickel powder, so as to achieve the desired composition. Then, after cold compaction of the powdered mixture, the compact is liquid phase sintered. The four-step liquid phase sintering process is intended to ensure maximum degassing, eliminate surface nickel oxide, homogenize the alloy, and complete densification of the alloy by liquid phase sintering.

The intermetallic compound, and regions, of the composite laminate material of the present invention will be seen to be produced from foils, or thin sheets, of different metals. U.S. Pat. No. 5,256,202 to Hanamura, et. al. issued Oct. 26, 1993 for a Ti—Al INTERMETALLIC COMPOUND SHEET AND METHOD OF PRODUCING SAME assigned TO NIPPON STEEL CORPORATION (Tokyo, JP) concerns a Ti—Al intermetallic compound sheet of a thickness in the range of 0.25 to 2.5 mm formed of a Ti—Al intermetallic compound of 40 to 53 atomic percent of Ti, 0.1 to 3 atomic percent of at least one of material selected from the group consisting of Cr, Mn, V and Fe, and the balance of Al, and a Ti—Al intermetallic compound sheet producing method comprising the steps of pouring a molten Ti—Al intermetallic compound of the foregoing composition into the mold of a twin drum continuous casting machine, casting and rapidly solidifying the molten Ti—Al intermetallic compound to produce a thin cast plate of a thickness in the range of 0.25 to 2.5 mm and, when necessary, subjecting the thin cast plate to annealing and HIP treating. The Ti—Al intermetallic compound sheet is stated to have excellent mechanical and surface properties.

2.2.2. Layered Armor

The composite material of the present invention, suitable for use as armor, will be seen to have regions, or layers (albeit without sharp boundaries) of differing materials. It has been known since ancient times to make armor in layers where each layer imparts some particular quality to the armor. Most recently the incorporation of hard ceramics in armor has been much pursued.

An exemplary U.S. Pat. No. 4,836,084 to Vogelesang, et. al. Jun. 6, 1989 for ARMOR PLATE COMPOSITE WITH CERAMIC IMPACT LAYER. This patent concerns an armor plate composite composed of four main components, viz. the ceramic impact layer, the sub-layer laminate, the supporting element and the backing layer. The ceramic impact layer is asserted to be excellently suitable for blunting the tip of a projectile. The sub-layer laminate of metal sheets alternating with fabrics impregnated with a viscoelastic synthetic material is perfectly suitable to absorb the kinetic energy of the projectile by plastic deformation, sufficient allowance for said plastic deformation being provided by the supporting honeycomb shaped layer. The backing layer away from the impact side and consisting of a pack of impregnated fabrics still offers additional protection. The optimum combination of said four main components is said to give a high degree of protection of the resulting armor plate at a limited weight per unit of surface area.

There is also present interest in putting high-strength fibers into composite materials suitable for armor. U.S. Pat. No. 5,635,288 to Park issued Jun. 3, 1997, for a BALLISTIC RESISTANT COMPOSITE FOR HARD-ARMOR APPLICATION concerns a ballistic resistant composite for hard-armor application. The composite includes a rigid plate, and a ballistic laminate structure supported by the plate. The laminate structure includes first and second arrays of high performance, unidirectionally-oriented fiber bundles. The second array of high performance, unidirectionally-oriented fiber bundles is cross-plied at an angle with respect to the first array of fiber bundles, and is laminated to the first array of fiber bundles in the absence of adhesives or bonding agents. First and second polymeric films are bonded to outer surfaces of the laminated first and second arrays of unidirectional fiber bundles without penetration of the films into the fiber bundles or through the laminate from one side to the other. Thus, a sufficient amount of film resides between the laminated first and second arrays of unidirectional fiber bundles to adhere the first and second arrays of fiber bundles together to form the ballistic laminate structure.

A combination of both the concepts of (i) intermetallic phase regions, and (ii) layers is shown in U.S. Pat. No. 4,853,294 to Everett, et. al. issued Aug. 1, 1989 for CARBON FIBER REINFORCED METAL MATRIX COMPOSITES and assigned to United States of America as represented by the Secretary of the Navy (Washington, D.C.). This patent concerns an improved metal, alloy, or intermetallic matrix composite containing carbon reinforcing fibers. The carbon reinforcing fibers are protected from interaction with the matrix material by an inner and an outer barrier layer. The outer layer is any one of the group of stable, non-reactive ceramic materials used to protect fibers, and the inner layer is a ductile, low density, oxygen desorbing rare earth metal. The carbon fibers are particularly useful in forming composites with a titanium aluminide matrix.

2.3 Why Hard Armor Fails

The failure of hard armor, and its penetration by projectiles, is enhanced when the speed of sound in the hard material of the armor is greater than the speed of the penetrating projectile, as is most often the case. Cracks propagate in the armor at the speed of sound (in the material of the armor), fragmentation occurs, and fragments are displaced from in front of the projectile before complete, energy-absorbing, deformation of these fragments by the projectile has occurred.

For example, the hardness of ceramic is unexcelled (save by diamond, and other rare materials not presently practical for armor). It is generally accepted that the ability of ceramic armor to defeat penetration by a projectile can be enhanced if the armor is confined—i.e., kept in place during impact—in order to limit fragmentation and fragment dispersion. However, in real ballistic events providing such confinement to ceramics is difficult and expensive to achieve.

The present invention will be immediately next seen to concern a material—a composite laminate material produced by a new, but simple, process—where a hard, ceramic-like, component is "kept in place" even during attempted penetration of the material by a high-speed projectile. Moreover, the flight of a projectile attempting penetration is significantly "interfered with", both in direction and in the orientation of the projectile, by the new material to the detriment of penetration of the material by the projectile.

SUMMARY OF THE INVENTION

The present invention contemplates a process of making (i) under modest pressure and (ii) at modest temperature (iii) in air a composite laminate material from sheets, or foils, of (i) a tough first metal initially interleaved with sheets, or foils, of (ii) a second metal that is suitably compounded with the first metal during the process to produce, ultimately, a very hard intermetallic region, or layer.

The present invention further contemplates that the composite laminate material so made can serve as hard armor where the very hard intermetallic, ceramic-like, regions or layers of the material are confined, and are held in place even under great stress, by dint of being "sandwiched" between tough metal layers. The confinement makes that any such fragmentation of the hard intermetallic layer by a high-energy impinging projectile as will inevitably occur will but poorly serve to displace the resulting hard fragments from in front of the projectile, forcing the projectile to interact with these hard fragments and limiting its penetration.

Moreover, and importantly, the tough metal layers serve to limit the cracking and fracturing of the hard intermetallic regions, or layers, in the first place (i) by blunting the propagation of cracks and fractures at the boundaries between the metal layers and intermetallic regions, and (ii) by channeling such cracks and fractures of the intermetallic regions as do occur in directions orthogonal to the axis of projectile impact (where they do little to promote projectile penetration)—instead of along the axis of impact (where penetration might be assisted). In simple terms, fracture cracks are hard to form in the composite laminate material of the present invention, and those that do form so form in the wrong directions to effectively remove (hard) fractured material from in front of an impinging projectile.

Moreover, the fracture cracks that form in the plane of the composite laminate material (or armor), and sideways to the path of the impinging projectile (instead of ahead of the projectile), do not evenly so form in either (i) space or (ii) time. The fracture cracks are not evenly angularly distributed about the point of projectile impact. Neither do they progress in a radially straight path, or any straight path, from the point of impact in any fracturing region. The fracture cracks do not even proceed along substantially identical paths as such cracks arise (with progressive penetration of the projectile) in successively deeper regions of the composite laminate material (or armor). This means that those crooked, non-straight, fracture cracks that do form do not identically so form over time. It is even believed that the sideways fracture cracks that are irregular in each of location, path, direction, and consistency do not even form at the same rate, nor at exactly the same times within laminate layers.

The exceedingly irregular spatial and, it is believed, temporal irregularity in formation of the fracture cracks interacts with the impinging projectile. The (significant, large) energy for the formation of the sideways irregular fracture cracks comes, of course, from the kinetic energy of the projectile. When this projectile energy is tapped first in one sideways direction to one extent at one time, and then in another, nearly random, sideways direction to another extent at another, pseudo-random, time, then these irregularly-occurring transverse perturbations to the projectile tend to severely disrupt its flight, and its penetration. The perturbations tend to turn the projectile (i) along its flight axis, and (ii) in its path of penetration (which are separate and different things). In somewhat exaggerated terms such as are, unfortunately, not precisely accurately descriptive of reality, it becomes as if a projectile attempting to penetrate hard material is forced to a sideways tilt with a wobble in the both the tilt angle and tilt direction while it attempts to penetrate along a meandering and crooked path (which path may not even be complimentary to the direction in which the projectile is tilted!) that changes over time (and at increasing depth of penetration).

All these spatial and temporal effects are devastating to the ability of the projectile to focus its energy on penetration. Spent projectiles have been recovered from the composite laminate material of the invention that have actually been turned sideways, and are penetrating substantially transversely to the original axis of impact. Although this "turning" is not alleged to be realizable for all combinations of composite laminate material versus projectile speed and energy (kinetic energy equals mass time velocity squared, $E=mv^2$) , it is clearly quite a "trick" to get any impinging high energy projectile turned sideways. Even if the projectile is not completely turned a full 90° in its path of penetration, it is clearly very difficult, and requires great energy, to force a wobbling projectile sideways along a meandering indirect path through hard material. The composite laminate materials in accordance with the present invention are accordingly very useful as hard armor.

The propensity of the composite laminate material to "turn" the penetrating projectile can be still further improved if the laminate material is corrugated, in which mode the laminate material may be readily economically fabricated. For the rare case that the projectile hits centrally in the trough of a corrugation, it is possible to back one layer of corrugated armor with another that is offset, thus making it effectively impossible that a penetrating projectile should not be subject to significant flight-direction-distorting forces.

1. Method of Producing Laminate Composite Materials, Especially as are Useful for Hard Armor, in Accordance with the Present Invention The present invention is based on a recognition that (i) no vacuum is needed, nor desired, in the reaction-sintering of metal foils so as to produce a quality intermetallic composite, and that the reacting of the foils should instead transpire in a hot-press furnace at atmospheric pressure and in the presence of atmospheric gases; oxidation not only presenting no problem but the oxygen and nitrogen gases from the atmosphere actually helping to produce a harder intermetallic compound.

The present invention is based on the further recognition that (ii) metal foils should not be quickly and explosively joined by the method of, or by exothermic reaction methods like, self-propagating high-temperature synthesis ("SHS") as is commonly used for processing elemental metal powders into intermetallics, but that metal foils should rather first be pressured together, and then somewhat leisurely (by standards of the prior art) reacted over a period of, typically, some 10+ hours during which period temperature rises and the metals of the foils form an intermetallic compound and region. One foil—made of a metal that is subject to liquefaction at elevated temperature and that would otherwise flow from the reaction site—becomes locked in place by solid state diffusion under pressure at a time before its melting temperature is reached. As the temperature is increased, this foil is totally reacted and consumed in making the intermetallic region, or layer.

Finally, the present invention is based on the still further recognition that the union of preferably large numbers of interleaved foils of two types of metal to produce a composite material should proceed until metal foils of one type are completely consumed, and are taken up into making an intermetallic compound with the metal foils of the other type, the composite laminate material ultimately produced thus consisting of (i) layers of the metal of a first type interleaved with (ii) intermetallic regions consisting of both the first—and the second-type metals.

Therefore in one of its aspects the present invention is embodied in a method of making a composite laminate material. In the method (i) a number of first foils made from one or more first metals and metal alloys are interleaved with (ii) a number of second foils made from one or more second metals and metal alloys suitable to compound with the one or more first metal and metal alloys to produce a hard intermetallic compound.

The interleaved foils are reacted under heat and pressure in the presence of atmospheric gases so as to substantially completely react the one or more second metals and metal alloys with the one or more first metal and metal alloys, forming where each second metal foil had been a region of hard intermetallic compound.

Thus a composite laminate material having (i) layers of one or more first metals and metal alloys, interspersed with (ii) regions of an hard intermetallic compound, is made. (There are no layers of the second metal and metal alloys remaining; all the second metal and metal alloys are reacted.)

The first foils are preferably made from one or more first metals or metal alloys from the group consisting of titanium, nickel, vanadium, iron and alloys and combinations of titanium, nickel, vanadium and iron. The second foils are preferably made from one or more second metals and metal alloys from the group consisting of aluminum and alloys of aluminum.

In greater detail, the reacting under heat and pressure normally consists of first placing the interleaved first and second foils under pressure; then raising the temperature of the pressured interleaved foils to (i) less than a melting point of the one or more second metals and metal alloys but (ii) sufficiently high so that, at pressure, solid state diffusion occurs between the interleaved foils, physically locking the foils in place; then further raising the temperature of the pressured, diffused, locked interleaved foils until all the one or more second metals are reacted with the one or more first metals to form an intermetallic compound, this raising being done sufficiently slowly and under sufficient continuing pressure so that, despite the fact that the reacting proceeds with increasing difficulty and an ultimate high temperature reached is greater than a melting point of the one or more second metals, the one or more second metals remain initially locked in place and ultimately become reacted without squirting in liquid state from between the first foils; and then, finally, cooling to room temperature the composite laminate material as is made from (i) layers of one or more first metals and metal alloys, interspersed with (ii) regions of an hard intermetallic compound. Notably, each and all of the placing, raising, further raising, and cooling transpire in the presence of atmospheric gases. The second foils become completely reacted with the first foils nonetheless that the temperature of liquefaction of the at least one second metals and metal alloys from which the second foils are made is exceeded during the process.

Commonly the number of first and second foils is more numerous than 10, and are most commonly 20–100. The first and second foils commonly have thicknesses in the range of 0.1 mm to 1 mm, and most often less than 0.2 mm. All foils of a type, or all foils together, can have, but certainly need not have, the same thickness.

The maximum temperature of the reacting is commonly in the range from 600–800° C. The pressuring is typically realized in a mechanical press, and more typically in a load press. The maximum applied pressure is typically in the range from 1–10 megapascals (1–10 MPa).

Although the in situ properties of the foils are difficult to measure, and must be estimated, the first foils (made from one or more first metals and metal alloys) typically have a plane strain fracture toughness, in the state of these first metals and metal alloys that is assumed to be, upon completion of the method, of greater than 40 MPa√ m. Meanwhile, the second metal foils (made from one or more second metals and metal alloys suitable to compound with the first metal and metal alloys) serve to produce an intermetallic compound having, typically, a Vickers microhardness of greater than 400 kg/mm$^2$.

2. Penetration-resistant Composite Laminate Material

In another of its aspects, the present invention is embodied in a penetration—resistant composite laminate material—although strict attention must be paid to exactly what is meant by the words "composite" and "laminate".

The composite material consists of a number of first metal layers, each consisting of one or more first metals and metal alloys, that have a high toughness, at least in the phase of the metals and metal alloys that is assumed within the final composite material. Notably, these first metal layers have and preserve this very high toughness because they are very thin. Should the layers be fused together as a monolithic thick plate then they would exhibit no where near this toughness.

The composite material further consists of a number of regions of intermetallic material interleaved with the first metal layers. This intermetallic material is not precisely in layers—although it is sometimes spoken of as being in layers; it actually constitutes the boundary regions between the metal layers themselves. This intermetallic regions consist of the first metals and metal alloys compounded with yet another, second, metal. The resultant compound, or intermetallic phase, typically has a Vickers hardness, at least as this material exists within the final composite, of greater than 400 kg/m$^2$.

In summary, the metal layers, separated as they are by the intermetallic regions, have great toughness per unit weight. Meanwhile, the intermetallic regions, separated as they are by the metal layers, are very hard. The resulting composite laminate material is very tough and very hard, and is thus penetration resistant and suitable for use, among other applications, as armor.

Therefore in another of its aspects the present invention is embodied in a composite laminate material. The preferred composite laminate material consists of (i) a number of metal layers of one or more tough first metals or metal alloys interleaved with (ii) a number of regions, coextensive with the metal layers, of hard intermetallic material, each region consisting of the one or more first metals and metal alloys compounded with one or more second metals or metal alloys. The tough metal layers are thus separated by the hard intermetallic regions. Notably, no second metals or metal alloys exist in native form, all being within the material of the hard intermetallic region.

The one or more tough first metals and metal alloys are preferably drawn from the group consisting of titanium, nickel, vanadium and iron, and combinations of titanium, nickel, vanadium, and iron. The one or more second metals or metal alloys are preferably drawn from the group consisting of aluminum and alloys of aluminum.

The resulting composite laminate material typically has a density between 3 and 4.5 grams per cubic centimeter, and most commonly less that 4 grams per cubic centimeter.

The metal foils from which the layers are created need not be "laid up", and reacted, in the absence of mechanical stresses other than the pressuring, but may instead be squeezed, buckled and/or corrugated as desired. Resultantly, the composite laminate material will have such residual internal stresses between the metal layers and the intermetallic regions as may be useful in intentionally directionally deflecting a penetrating projectile.

Particularly when so used for body armor, but also in general, the composite laminate material may have and assume, as an incident of its fabrication, three-dimensional, non-planar, contour.

3. Armor

Therefore in yet another of its aspects the present invention will be recognized to be embodied in armor.

Armor in accordance with the present invention consists of a laminate composite material having (i) at least 10 metal layers, at least 100 $cm^2$ in area, of at least one tough first metal or metal alloy; separated by and interleaved with (ii) at least 9 hard intermetallic regions, coextensive with the metal layers and thus at least 100 $cm^2$ in area, of the at least one tough first metal or metal alloy compounded with at least one second metal or metal alloy. Thus tough metal layers are separated by the hard intermetallic regions. Notably, no appreciable second metals or metal alloys exist in native form, all being within the hard intermetallic material.

The at least one tough first metal or metal alloy is preferably drawn from the group consisting of titanium, nickel, vanadium and iron, and combinations of titanium, nickel, vanadium, and iron. The at least one second metal or metal alloy is preferably drawn from the group consisting of aluminum and alloys of aluminum.

The armor typically has a density between 3 and 4.5 grams per cubic centimeter, and more typically less that 4 grams per cubic centimeter.

It may have residual internal stresses between the metal layers and the intermetallic regions, be conformed and adapted to non-planar contours. It is a strong candidate to meet the threat Level IV standard for body armor as defined by National Institute of Justice standard 0101.03 as of Jan. 1, 1998.

Although hard to measure, the metal layers normally have a 10 toughness greater than 40 MPa√ m while the regions of intermetallic material have a Vickers microhardness of greater than 400 $kg/mm^2$.

Any of the metal layers and/or intermetallic regions may be of differing thickness. Such residual internal stresses as exist between the metal layers and intermetallic regions may serve to more substantially deflect a penetrating projectile from off its axis of impact than would be the case for the same penetrating projectile without the residual internal stresses.

The non-planar contours to which the composite laminate material is conformed and adapted may be: corrugations. Forming the material in the contour is a simple matter of laying up thin metal layers, or foils, that are corrugated before subjection the stack of metal layers, or foils, to heat and pressure. It is of no matter that slight air pockets and/or a slight mechanical mis-match of corrugated foils might initially exist in the stack. Everything forms into the solid composite material during processing.

The corrugated composite laminate material enjoys all the normal mechanical and strength advantages of corrugation. In other words, it may be capable of better supporting a load aligned with axis of corrugations in the plane of the material without buckling or bending. To this extent the utility of the material for construction, including for load-bearing walls and the sides of armored vehicles, is enhanced. Equally importantly, the corrugations help to turn the path of an impacting projectile. To account for the statistically small probability that the projectile should hit centrally in the trough of a corrugation, it is possible to back one panel of corrugated armor with another, offset, panel. If structural strength is desired in two perpendicular directions in the plane of a composite laminate material of the present invention, then corrugated panels of the material having their corrugations running in one direction may be alternated with other panels of the material having their corrugations running at a 90° angle.

Practitioners of the building and structural materials arts will recognize that complex forms of the composite laminate material of the present invention may readily be designed, and built, for structural strength as well as inherent impact resistance. For example, the circular surround around the hinged access hatch lid on the turret of a tank is a complex form. It is clearly possible to "lay up" sheets, or foils, to form composite laminate bodies having any of (i) a pre-cut central aperture and/or apertures for bolts, (ii) contours such as those of the hatch mating surfaces and of the turret, and (iii) regions that are relatively thicker, whether from foils that are regionally thicker or from regional use of more layers of foils. It is axiomatic that (i) complex forms can be efficiently built with the laminate process of the present invention, and (ii) the making of such complex forms in no way negates the essential strength advantages of material of the invention, particularly for use as armor.

4. Inexpensive High Performance Composite Materials

Accordingly, the present invention may still further be considered to be embodied in an economical material of exemplary properties.

In accordance with the present invention, first-metal films, normally 10 or more of 0.1 to 1.0 mm thickness of titanium, nickel, vanadium, and/or steel (iron) and alloys are interleaved with 9 or more second metal films, normally also 0.1 to 1.0 mm thickness, of aluminum or alloys thereof. Both films are economically commercially available.

The stacked metal films are conventionally heated to a modest 600–800° C. while being pressured at a modest 1–10 megapascals, normally in the open air in a load frame. The composite material thus formed has (i) very tough first-metal layers separated by (ii) very hard intermetallic regions consisting of a compound of the first and second metals. The material density of, typically, 3 to 4.5 grams/cubic centimeter is both lightweight and strong to serve as armor.

As explained in the preceding section on armor, the composite laminate material may readily be formed in complex, three-demensional, shapes, generally including shapes with voids and cavities.

These and other aspects and attributes of the present invention will become increasingly clear upon reference to the following drawings and accompanying specification.

BRIEF DESCRIPTION OF THE DRAWINGS

Referring particularly to the drawings for the purpose of illustration only and not to limit the scope of the invention in any way, these illustrations follow:

FIG. 4 is a graph showing temperature in the preferred process of the present invention, where pressured heating of interleaved metal sheets transpires in a load press in the presence of atmospheric gases to make the preferred embodiment of the composite laminate material in accordance with the present invention previously seen in FIG. 2.

FIG. 5 is a graph showing pressure in the preferred process of the present invention, where pressured heating of interleaved metal sheets transpires in a load press in the presence of atmospheric gases to make the preferred embodiment of the composite laminate material in accordance with the present invention previously seen in FIG. 2.

FIG. 6 is a prior art Table 1 showing typical values of plane strain fracture toughness for metal sheet materials of interest in the present invention.

FIG. 7 is a prior art Table 2 showing typical values of Knoop microhardness data for nickel and nickel intermetallic phases for hot-pressed Ni—Al disks, and titanium and titanium intermetallic phases for hot-pressed Ti—Al disks (25 g load), as materials of interest in the present invention.

FIG. 8*a* is an end view of the fabrication of a corrugated panel embodiment of the composite laminate material in accordance with the present invention previously seen in FIGS. 1 and 2.

FIG. 8*b* is an end view showing how several, by way of illustration four (4), corrugated panels, each one of which is a complete panel producible by the process illustrated in FIG. 8*a,* may be fitted in staggered phase relationship so as to produce a larger structure, or wall.

DESCRIPTION OF THE PREFERRED EMBODIMENT

Figure 1:
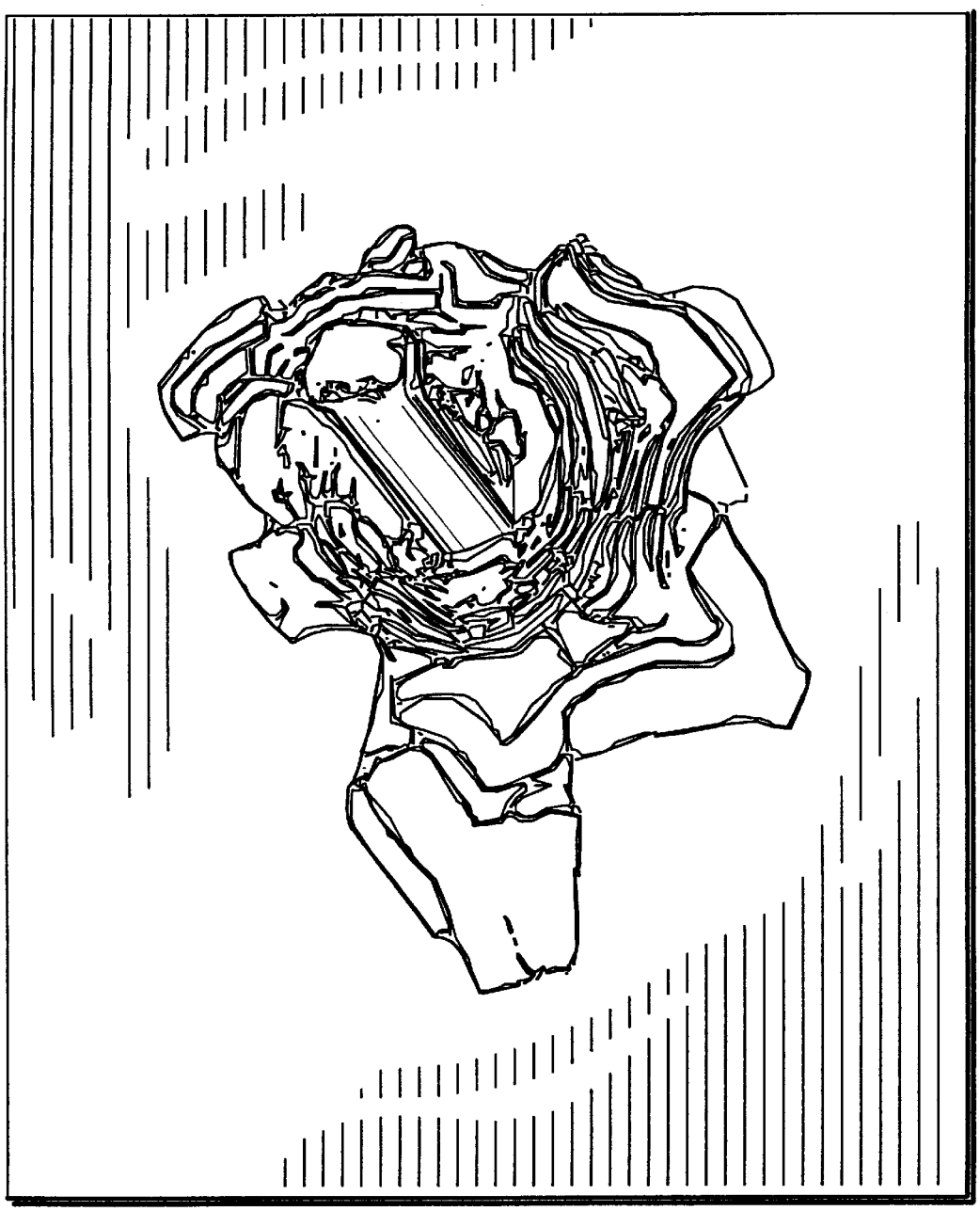
FIG. 1 is a diagrammatic view showing a projectile producing a "metal flower" within armor made from a preferred embodiment of a composite laminate material in accordance with the present invention.

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

1. Theory of the Performance of Armor Made From the Composite Laminate Material of the Present Invention The instant theory of the performance of the composite laminate material of the present invention when employed as armor must be held to be hypothetical, and to be only a best present estimate of what transpires when a projectile impinges upon the composite laminate material. It is possible to estimate the hardness of the embedded intermetallic regions, or layers, by measurement of these layers when situated outermost in the composite material. These regions are, however, very hard, as discussed hereinafter. It somewhat difficult to determine exactly how tough are the metal layers in the composite laminate, although single metal foils in isolation are very tough.

Furthermore, the actual evolution of destruction in the composite laminate material due to penetration, or attempted penetration, by a projectile cannot be clearly observed, even with high speed photography, because there is a considerable amount of debris generated, as will become obvious from inspection of post-event photographs. The ensuing explanation, and theory of operation, of the present invention is based on careful observation of phenomena, and represents the best present understanding of what transpires during use of the composite laminate material of the present invention as armor. It will be understood that, even if the theory is in part wrong, or, more likely, the value and effect of some supposed function of the new material is overemphasized while some other function is underemphasized, the invention is in no way negated. Exposition of the theory of the invention, howsoever it may be flawed, is useful because it suggests avenues of further engineering, and improving, the composite laminate material of the invention, especially when used as armor.

As previously stated in the SUMMARY OF THE INVENTION section, the composite laminate material of the present invention serves to confine, and to hold in place under great stress, very hard intermetallic, ceramic-like, regions or layers by act of "sandwiching" these regions between tough metal layers. The confinement maintains hard fragments resulting from the fragmentation of the hard intermetallic layer (which is inevitable at sufficient projectile energy) in front of the projectile, forcing the projectile to interact with these hard fragments and limiting its penetration.

As was also previously stated, these tough metal layers also serve to limit the cracking and fracturing of the hard intermetallic regions, or layers, by blunting cracks and fractures at the boundaries between the metal layers and intermetallic regions. Moreover, such cracks and fractures of the intermetallic regions as do occur tend to occur in directions orthogonal to the axis of projectile impact. Cracks and fractures in these directions do little to remove material from in front of the projectile, and to promote projectile penetration.

Thus fracture cracks are both (i) hard to form in the composite laminate material of the present invention, and those that do form (ii) form in the wrong directions to effectively remove (hard) fractured material from in front of an impinging projectile.

Still further, the fracture cracks that form in the plane of the composite laminate material (or armor), and sideways to the path of the impinging projectile (instead of ahead of the projectile), do not evenly so form. The fracture cracks are not evenly angularly distributed about the point of projectile impact, they are not radially straight in any fracturing region, and they do not even maintain a substantially identical path as deeper regions of the composite laminate material (or armor).

It is believed that the irregular sideways fracture cracks do not even form at the same rate, nor at the same times—whether from layer to layer or, quite possibly, even within the same layer. The (significant, large) energy for the formation of these sideways fracture cracks comes, of course, from the kinetic energy of the projectile. When this projectile energy is tapped first in one sideways direction to one extent and then in another, nearly random, sideways direction to another extent, it tends to turn the projectile (i) along the flight axis of the projectile, and (ii) in its path of penetration (which are separate and different things). In very extreme terms which are, unfortunately, not reached in reality, it is as if a sideways-tilted projectile is trying to penetrate along a crooked path (which may not even be complimentary to the direction of projectile tilt!) through hard material.

The composite laminate materials of the present invention thus serve, at least to a modest extent, to "turn" the energy of penetrator away from the axis of penetration—more so than the simple "spreading" of energy which will occur in any armor when penetration resistance is accorded at the point of projectile impact—and to "channel" appreciable energy of impact orthogonally to the axis of penetration, and in the plane of the armor.

Armor in accordance with the present invention will be seen to be based upon large numbers of tough metal sheets—which sheets are formed by a particular, effective, process into a composite laminate material having very hard intermetallic regions. The sheets are tough to resist penetration, but may, albeit still with great force and energy, be "ripped". In other words, the sheets function much as sheet of common paper, where it is difficult to put one's finger through the sheet but the sheet may somewhat more readily be torn. Laminate composite armor in accordance with the present invention is characterized for producing a substantially unique pattern in response to an impinging high-energy projectile:

a three-dimensional "peeling back" of successively deeper metal sheet layers until something that looks substantially like a metal flower with petals is formed. An example of such a "metal flower" formed by a tungsten projectile in the composite laminate material of the present invention is shown in FIG. 1. The event, and view, chosen is intentionally "showy", and likely represents a bad "match" between an armor 1 of quite thin sheets and regions with a tungsten projectile 2 that has nearly succeeded in penetration. The view is choose for revealing what is going on much better than would some view of but a modestly enlarged hole, or a mere nick.

Depending upon its size, and the number of "petals" that "peeled back" (i.e., the number of laminate layers disrupted), it takes a very large amount of energy—which energy must, of course, come from the impinging projectile—to make the "metal flower" 11 in the armor 1. Projectile energy spent in deforming the armor 1 laterally to the axis of impact cannot, of course, be used for penetration.

Moreover, and further, and importantly, the interaction of the (tough) metal sheet layers 12 of the armor (as are separated by (hard) intermetallic regions 14) (shown in FIG. 2) with the impinging projectile 2 is not uniform circumferentially around the point of penetration, and the body of the penetrator. This is simply because the radial "tear", or "fracture", "lines" in the metal sheets will not form at even angular separation, nor even in straight lines. This uneven interaction between the armor and the penetrator clearly "turns", or "tilts", the body of the projectile/penetrator 2 from the axis of its impact. This makes that the projectile/penetrator 2, for example a bullet, is soon trying to travel a path laterally through the armor 1 in an attitudinal position that is, if not sideways, at least likely to be severely off the original flight, and the preferred penetration, axis of the projectile/penetrator 2 The armor 1 does not "deflect" the projectile/penetrator 2, it "turns" or "tilts" or "skews" it.

A modestly "turned" or "tilted" or "skewed" projectile/penetrator 2, say one that becomes tilted from 15–30°, normally continues to penetrate best at its (hard, often originally pointed) tip region. This means that the tilted projectile/penetrator 2 is soon attempting to "burrow" a tilted "hole" through the armor 1, and not a straight "hole" at that, but rather one that is progressively changing. Directional variations in the "rip resistance" properties of the metal sheets of the composite laminate armor 1 may even cause the "hole" to start to meander.

Note that this penetrator "turning" or "tilting" or "skewing" effect of the armor 1 is cumulative. Totally unlike normal armor where the nature of the reaction—explosive ablation—between the armor and the penetrator is essentially the same, albeit with progressively less energy, from beginning to end, an impinging projectile attempting to penetrate successively deeper into armor 1 in accordance with the present invention will become increasingly skewed, and, as a subsidiary, but separate, phenomena, this projectile will proceed along a penetration path that is likely (i) tilted relative to the plane of the armor 1, and (ii) bent, and (iii) crooked.

There is a clear problem in trying to "drive" a tilted penetrator body along a meandering skewed bent pathway through hard armor more than just the obvious indirectness, and attendant inefficiency, of the path. The (i) tilted, (ii) bent and/or (iii) crooked path means that some energy of the penetrator body is being coupled to deforming the armor in not just one, but worse, several directions other than the axis of impact.

All this can be discerned from the "metal flower" produced in armor of the present invention by a penetrating body; which "metal flower" is deserving of careful study. The "metal flower" is not highly regular, as might be a plant flower in nature. It is likely lopsided. The petals—even as are formed from metal sheet of the same layer—are of uneven size. The lines along which successively deeper layers "rip" not only migrate in angular position relative to each other, and from layer to layer along a single "fault", but these "rip" lines (i) reverse angular direction, and (ii) migrate in one angular direction from upper to lower layers simultaneously that other lines are migrating in the opposite angular direction. Some "peeled back" layers as form the "petals" of the "metal flower" are regionally strongly so peeled back, and are "tight up against" the "petal" (which were previously "peeled" from the next-most upper layer) that is next in front, while the petals of other regions and/or other layers are more distantly separated from adjacent petals.

In summary, the "metal flower" is very irregular in many characteristics. What does this mean? Is it good or is it bad?

It is maintained that this irregularity, as well as the very existence, of the "metal flower", means that the energy of the impinging projectile is not only being dissipated laterally in the armor, but that even this energy of the projectile is being but inefficiently coupled to destroying—by "ripping", if that is the appropriately descriptive word—the armor. This ineffective focus of the impinging projectile's energy not only means that, appropriate strength armor being encountered, the projectile will fail to penetrate the armor but that, worse yet, it will "destroy"—by re-shaping it in the contour of an interesting, but functionally useless "metal flower"—only a small area of the armor. Other, closely adjacent, areas of the armor remain totally intact, and capable of performing to stop subsequent projectiles. Accordingly, the armor has "multi-hit" capability.

It is respectfully suggested that armor in accordance with the present invention is doing more than meeting strength with strength, and hardness with hardness, in resisting penetration by a projectile. It is attempting to "finesse" the projectile, and to interfere with (as well as simply overcome) its essential function.

The action of the composite laminate material (or armor) of the present invention on a projectile is remotely similar to what happens (at an entirely different scale) when a hunting bullet is attempted to be shot at a target (a deer, perhaps) through a dense thicket of bushes. As most hunters know, irregular deflections of the bullet by the bushes make it almost impossible to deliver the bullet on target, or even to penetrate the thicket. Notably, the immunity of a hunting bullet to deflection (by a particular type of material; wood brush) is a function of bullet weight and bullet velocity, with superior deflection immunity (surprisingly?) obtained in intermediate ranges.

So also the armor of the present invention contemplates continuation of the eternal struggle between makers of penetrating projectiles and makers of armor, being that projectiles and projectile velocities can be engineered that are more, and less, suitable to penetrate particular armors in accordance with the present invention. So also if the projectile mass and velocity is known, the armor can be engineered.

In particular, it may be useful to try and penetrate the composite laminate material of the present invention more directly, and forthrightly, by using a projectile of higher speed. This is always desirable anyway because projectile kinetic energy is proportional to the square of velocity, $E=\frac{1}{2}mv^2$. Fortunately—or unfortunately as the case may be that one is attempting to protect with, or to overcome, armor—projectiles accelerated in barrels of reasonable length by the gases resultant from the explosion of gunpowder can be accelerated only so far into the hypersonic realm. It is anticipated, in accordance with Newton's law that each action causes and equal an opposite reaction, that the distorting forces on the penetration path of a projectile produced by armor in accordance with the present invention will persist even for the fastest (and most energetic) projectiles. The question is whether these penetration-path-distorting forces will have sufficiently long to act so as to be of any beneficial effect. Preliminary estimates are that the distorting forces will so have adequate time to act, and effect, on even the fastest projectiles.

2. Genesis of the Present Invention

The stages of development of this invention started with the inventor's childhood fascination with the ocean and seashore, specifically with sea shells. That sea shells were so hard to break, even when impacted by other shells or rocks found along the beach, intrigued the inventor, now (circa 1998) a Professor at the University of Calif., as a youth.

Over the past ten years, considerable research has been undertaken in the area of understanding the damage and fracture behavior of shells. This work has shown that the shells are composed of hard ceramic layers separated by ductile (polymer-like) layers. The combination of these two layers provides hardness to resist damage and toughness to mitigate the extent of the damage. Using this knowledge, the inventor speculated that the basic concept of these property combinations in layered materials could be developed into armor materials using metals to create laminate materials which contain both these material types. Although the concept of the sea shell layered structure is important, the actual materials involved had to be much harder and tougher than those present in sea shells. This need for harder and tougher materials led the inventor to the idea of using (i) metals and (ii) intermetallic compounds formed from metals as the basic material components.

The next step was to determine a process by which a material having a layered structure consisting of both hard intermetallic materials and ductile metals could be fabricated. To this end, the inventor initially made use of an existing technology, which was initially developed in Germany, called "foil metallurgy". In this process elemental metal foils are reacted them together to produce a single intermetallic compound from the entire mixture. The technique originally pioneered by the German group involved considerable processing facilities, including the use of Hot-Isostatic Pressing "HIPing", which is quite expensive and can be significantly limiting to specimen sizes.

Several further experimental fabrication attempts included the vacuum hot pressing of foil samples only 1 centimeter square, which process is also expensive to operate and limiting on specimen size. It should be pointed out that the use of these prior art processes by others have been directed solely to producing intermetallic compounds, or composites, with no specific application presented. Moreover, it was heretofore believed that it was necessary to exclude air, and particularly oxygen and nitrogen, lest oxidation of the reacted metals inhibit the formation of an intermetallic compound.

The process of the present invention is based in the realization that, with proper technique, intermetallic regions can be formed in a process done in the open air, with no vacuum nor any isostatic pressing facility required. Furthermore, the oxygen and nitrogen in the air serve in particular, to beneficially make the intermetallic compound harder (even as they might inhibit its formation).

The process of the present invention is a combination of (i) solid-state, and (ii) transient liquid-state, reactions. The technique is related to reaction sintering used for powder reactions; however sheet metals, and not powders, are used as the initial process inputs, and pressure and temperature are applied selectively to realize, as states, the (i) solid-state, and (ii) transient liquid-state, reactions.

3. The Preferred Apparatus of Fabrication

Figure 3:
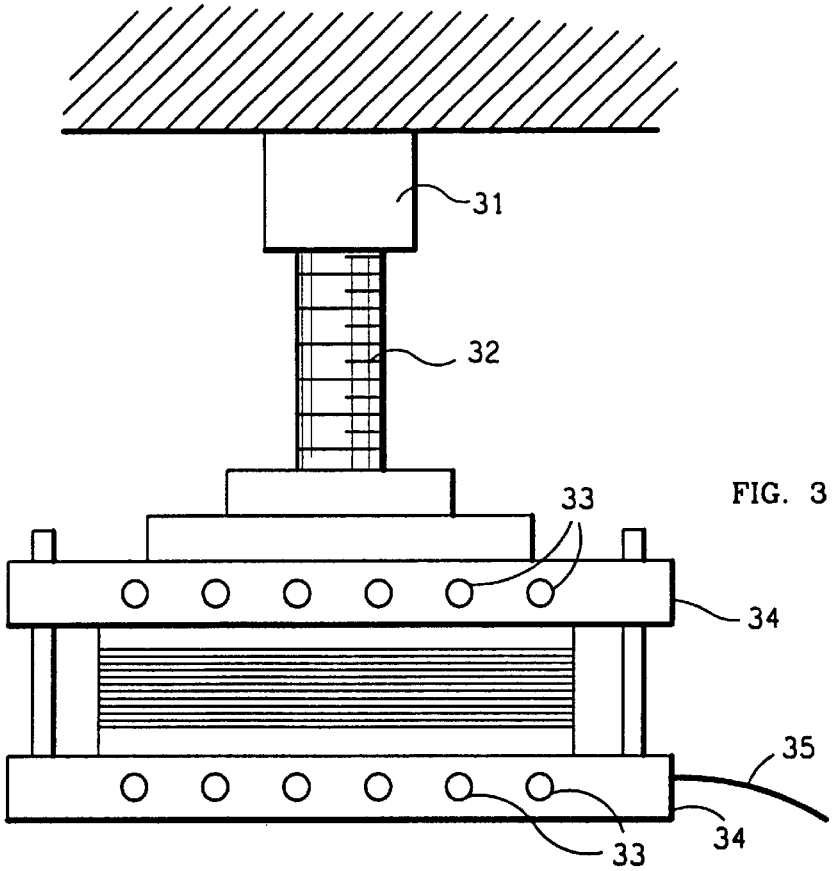
FIG. 3 is a side view of an atmospheric pressure hot-pressing facility used to perform the process of the present invention to produce the composite laminate material of the present invention previously seen in FIG. 2.

A hot-pressing facility for fabricating the metallic-intermetallic laminate composites of the present invention is shown in FIG. 3. The hot-pressing facility consists of main components: load cell 31, load-fame loading bar 32, cartridge heating elements 33, ni-alloy compression platens 34, thermocouple 35, load-frame crosshead 36 and guide pins 37. All components operate on work piece foils stack 10.

The load cell 31, load-fame loading bar 32, ni-alloy compression platens 34, load-frame crosshead 36 and guide pins 37 serve to place a controllably variable pressure on the foils stack 10. The cartridge heating elements 33 as sensed by the thermocouple 35 serve to variably controllably heat the foils stack 10.

An Instron load frame was modified to serve as the mounting platform for all other components, as well as providing the pressing apparatus. The load frame was upgraded and customized to serve the particular preferred design parameters, and to permit complete computer control of the pressing operation.

4. The Preferred Process of the Present Invention

The preferred process of the present invention commences by stacking metal foils of either Titanium or Ti alloys, Nickel or Ni alloys, Vanadium or V alloys, or steels of many varieties, alternatively with foils of aluminum or aluminum alloys. The material type and foil thickness is chosen to produce a specific final microstructure in terms of metal and intermetallic layer thickness, layer properties, and overall specimen density and size.

The foils are then pressed together in a load frame in open air, and heated. A side view of an atmospheric pressure hot-pressing facility used to perform this process is shown in FIG. 3.

When the proper temperature is achieved within the stacked foils, a reaction initiates between each aluminum foil surface and the metal layer in contact with that surface. Depending on the metal foils combination, the reaction may be either solid state or liquid state. When the reaction occurs, careful control of both temperature and load must be undertaken to ensure that reaction proceeds in a stable manner, such that the reacted product is not ejected from the stack and that complete consolidation of the stack is achieved when the reaction is completed. The reaction between the aluminum and other metal results in the formation of the intermetallic compound, and the reaction is terminated when all of the elemental aluminum is eliminated. The resulting intermetallic layer composition and thickness, and the remnant other metal layer thickness are controlled by the initial choice of metal foils and thickness. However, unlike reaction sintering of powders, the preferred process is not a self-sustaining reaction and can be controlled by temperature and pressure. Through the selection of initial foils, the final material's properties can be tailored to achieve nearly any combination of properties from the complete intermetallic compound's properties (high hardness, high strength, low toughness and low density) to the non-aluminum metal's properties (good strength, moderate hardness and density, and high toughness). For example, in the case of the Ti—Ti aluminide composites, the overall density of these materials can be varied from approximately 3.0 to 4.5 grams/cubic centimeter.

Figure 2:
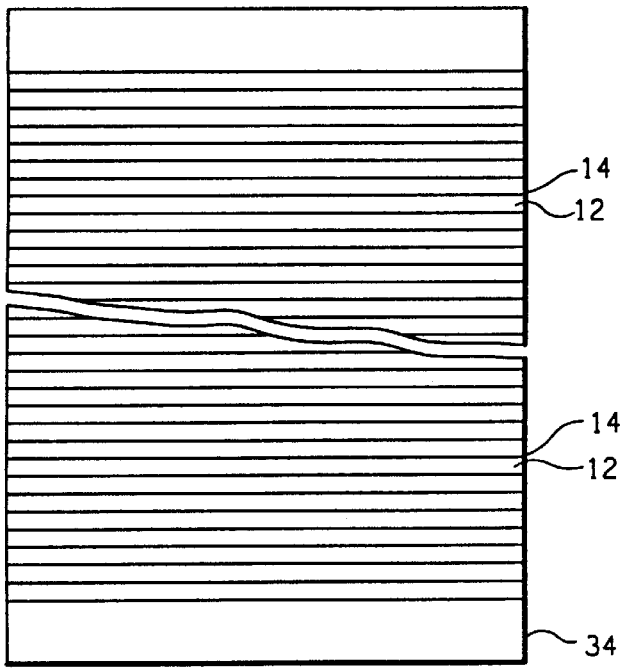
FIG. 2 is a diagrammatic cross-sectional view showing at enlarged scale the preferred embodiment of the composite laminate material in accordance with the present invention previously seen in FIG. 1.

In particular, and by way of example, a graph showing temperature in the preferred process of the present invention—where pressured heating of interleaved metal sheets transpires in a load press in the presence of atmospheric gases to make the preferred embodiment of the composite laminate material in accordance with the present invention previously seen in FIG. 2—is shown in FIG. 4. Similarly, a graph showing pressure in the same preferred process is shown in FIG. 5.

In region 41 of the preferred process, the stacked foils (see FIG. 3) are loaded to approximately a 4 MPa, or higher, pressure (see FIG. 5) and heated to approximately 600° C. (see FIG. 4). The foils are held some hours, illustrated as 3 hours in region 42, at this temperature (600° C.) and pressure (4 MPa) until, importantly, solid state diffusion bonding of the foils has occurred. This crucial step will prevent that the foil of lower melting point—the aluminum and aluminum alloys—will not flow as liquid out of the load press (see FIG. 3) during ensuing processing.

Next in region 43, pressure is decreased to approximately 2 MPa (see FIG. 5) and while the temperature is increased to approximately 640° C. (see FIG. 4). At the end of this region 43 the metal foils are now completely bonded, although most definitely not completely reacted.

Next in region 44 high, preferably increasing, temperature must be applied to, along with preferably increasing pressure, "drive" the reaction—increasingly difficult of transpiring as more and more of the metal is converted to intermetallic compound until, at point 45 of, typically, 4 MPa and 700° C., all the aluminum and aluminum alloy has been reacted, and converted to intermetallic compound. Note that the temperature of reaction has exceeded the melting point of aluminum (660° C.). After this point 45 is reached, the laminate composite is allowed to cool slowly in region 46, preferably while the 4 MPa pressure is maintained.

5. Preferred Parameterization of the Process of the Invention

The sheet materials typically processed included: pure Ti (0.125 mm thick), pure Al (four thicknesses: 0.015 mm, 0.025 mm, 0.050 mm, and 0.10 mm). The four Al foil thicknesses, in combination with the one Ti thickness permitted four initial intermetallic thicknesses to be investigated.

In use of the hot-press facility, typically 20–40 films of a strong first metal, normally 0.1–0.25 mm thick films of titanium, nickel, vanadium, and/or steel (iron) and alloys thereof, are interleaved with a like number of films of a second metal, normally thick films of aluminum or alloys thereof. The exterior films are normally of the first metal, making that there is one more of these films in the stack than are the number of films of the second metal.

The stack of metal films is heated to a modest 600–800° C. while being maintained under a modest, four megapascals (4 MPa), pressure.

When the aluminum starts to liquify after about three hours the pressure is preferably dropped, typically over about a two hour period, to two megapascals (2 MPa). The lower pressure helps to prevent that liquid aluminum should "squirt" out the sides of the mold, and gives the aluminum time to react with the titanium in place.

As the aluminum so reacts with the titanium to form the intermetallic compound over, typically most predominantly, the fifth through tenth hours, it becomes more and more difficult to react the diminishing amount of remaining aluminum through the thickening intermetallic compound. Therefore, preferably, the pressure is again elevated, normally back to about four megapascals (4 MPa), during the tenth through fourteenth hours. A practitioner of the art of metallurgy will understand exactly what is desired, and will be able to adjust the process parameters even with disparate metal materials and different thicknesses of metal materials so as to obtain a substantially complete reaction.

Completion of the formation of the intermetallic compound is a function of the initial thickness of the aluminum films, but the reaction is normally complete in about 14+ hours. The reaction should be permitted to proceed until all, and most preferably absolutely all, the aluminum film is taken up into neighboring regions of the first metal films, and no (preferably, absolutely no) native aluminum remains.

In other words, no layer nor film of the second metal (e.g., the aluminum) persists in the finished product, the second metal having completely gone to form, along with the first metal, the intermetallic regions. Notably, the formed intermetallic regions are not so thick as to completely penetrate the first-metal films (from each side). Between the intermetallic regions there will preferably remain remaining regions, properly called films or layers, of the native first metal.

It will be understood from the theory of the invention that the toughness of these remaining regions, films or layers, of the native first metal (e.g., the titanium) is important to the toughness of the composite materials. The process of the present invention is therefore distinguished from merely laminating metal sheets together under heat and pressure for using very particular metals, heats and pressures as serve, in aggregate, to produce a very particular preferred composite laminate product.

6. Characteristics of the Composite Laminate Material so Fabricated

The resulting composite laminate material has (i) very tough first-metal layers separated by (ii) very hard intermetallic regions consisting of an intermetallic compound of the first and second metals. It is inexpensive, commensurate with the commercial availability of the standard films, or sheets, from which it is formed and the simplicity of the fabrication process. It is lightweight with a typical density of typically 3 to 4.5 grams/cubic centimeter.

First and foremost, the composite laminate material is very tough. It may suitably serve as, among other applications, lightweight armor.

Continuing present investigations, circa 1998, are focusing on the level of microstructural control that can be achieved and maintained in the new composites.

7. Use of Particular Metallic-Intermetallic Composite Laminate Materials so Formed as Armor Development has focused on metal-intermetallic (Ti/Ti-aluminide) composites fabricated as multi-layer, light-weight, armor materials. The emphasis has been to correlate (i) the hierarchical composite microstructures in terms of phases present, volume fraction of the phases, layer thickness, and residual stress state within the composites with (ii) projectile penetration performance, particularly spallation resistance.

The metallic-intermetallic laminate composites based on, for example: the titanium metal/titanium-aluminide intermetallic material combinations, have the advantages of light weight, a unique combination of high hardness and high toughness, and a layered, laminated structure which is inherently damage tolerant. In addition, unlike many other new material developments, the process for creating these new laminate materials is relatively inexpensive, simple to create and control, requires no expensive equipment, and makes use of "off-the-shelf" sheet metals.

Initial development proceeded with the fabrication of small 3 inch square samples, approximately 0.2 inch thick, containing 40–70 layers of the two materials. Initial penetration testing of these laminate composites provided some very promising results. For example, a piece of the Ti—Al laminate 0.2 inch thick was capable of stopping a 10 gram W-penetrator fired at 500 meters/s. A similar test on steel armor, resulted in more than ⅜ inch penetration. This represents nearly a factor of 4 improvement in penetration resistance based on specific density and thickness.

Further development efforts were focused on increasing the overall size and thickness of the armor plates, which have been fabricated as 6 inch square samples, 1 inch thick. Other intermetallic combinations have been developed including Ni—Al, 304SS-Al, and Ti alloy-Al.

In addition, and of specific interest and application to armor technologies, the resulting composite materials contain a highly layered microstructure which imparts specific properties for impact resistance and damage tolerance. The layered sheet microstructure imparts to the material, the ability to transfer impact energy imposed normal to the surface, to lateral de-lamination of the layers parallel to the layer thickness. Furthermore, due to the nature of the fabrication technique and the physical properties of the layered materials, considerable internal residual stresses can be developed within the layers. When these layers are impacted and damaged, the residual stresses can cause the metal layers to recoil (or as I have termed it "blossom") against the projectile and deflect the projectile. This additional deflection of the project can lead to the projectile impacting in a more oblique manner, rather than the initial normal or perpendicular impact condition (a significant improvement in impact resistance is achieved under oblique impact conditions).

Finally, although the initial application for these materials is intended to be light-weight armors, a wide range of additional potential applications have been envisioned. Through this technique, it should be possible to fabricate "near net shaped" parts, since the initial metallic foils can be shaped into a wide variety of configurations, alternatively stacked, and reacted in a similar manner to what has already been developed for the flat foils. This improvement would open the door for a wide range of additional applications including: missile nose cones, aircraft components such as wing leading edges, jet and land-based gas turbine engine components and engine shrouds, engine afterburner nozzles, etc.. Due to the low cost of this processing technique and the variety of material properties which can be created, the range of potential applications and new technologies which could subsequently be developed is quite large.

8. Objectives of Lightweight Armor

The need for light-weight armor materials which are damage tolerant, and capable of defeating rifle-fired armor piercing rounds, has been of great interest to both military and civilian personnel responsible for personnel body armor. In addition, light-weight armor is of interest to the military and civilian police for vehicle armors. Current technology of using steel, titanium, or ceramic armor materials as inserts in Kevlar jackets and vests cannot defeat an armor piercing round, due to their limited damage-tolerance. In order for existing materials to defeat this type of threat, sufficiently thick pieces of material are necessary, to point of making the material too heavy for most applications.

The prior art Table 1 of FIG. 6 shows typical, prior art, values of plane strain factor toughness for metal sheet materials of interest in the present invention. Finally, the prior art Table 2 of FIG. 7 shows typical, prior art, values of Knoop microhardness data for nickel and nickel intermetallic phases for hot-pressed Ni-Al disks, and titanium and titanium intermetallic phases for hot-pressed Ti—Al disks (25 g load), as being materials of interest in the present invention.

From these specifications and these charts fabrication in accordance with the present invention of various forms of armor is a mere matter of materials selection.

The armor of the present invention is particularly adaptable for vehicular, and for stationary perimeter defense, applications when fabricated in corrugated form. FIG. 8*a* shows an end view of the fabrication of a corrugated panel in accordance with the present invention. The corrugated sheets, or foils, 12' and 14' correspond to the planar sheets, or foils, 12 and 14 previously seen in FIG. 2. Note that these sheets, or foils, 12' and 14' are preferably pre-formed with corrugations—matching the corrugations of corrugated pressing plates 34—before entrance into the process.

FIG. 8*b* is an end view showing how several, by way of illustration four (4), corrugated panels. Each single corrugated panel is a multi-laminate composite producible by the process illustrated in FIG. 8*a*. The panels are preferably placed one relative to the next in staggered phase relationship so as to produce a larger structure, or wall. Particularly in FIG. 8*b*, the phase of the corrugations in each panel is offset 45°, or one-eight wavelength, from the adjacent corrugated panel. The volume between the panels may be filled with metal foam (illustrated), air, fire retardant, penetration resistant fibers, or any number of materials.

It is also possible to align successive corrugated panels of the composite laminate material in accordance with the present invention with their corrugations in orthogonal orientation (not shown)

It will be recognized by a practitioner of the metalworking and/or building arts that a corrugated panel is load-bearing in one of its two planar axis, and that several spaced-parallel corrugated panels may suitably bear high loads within, as well as transversely to, their substantial planes. Accordingly, arrayed composite laminate panels in accordance with the present invention make good construction materials, such as for the sides of armored fighting vehicles and for buildings.

In accordance with the preceding explanation, variations and adaptations of the metallic-intermetallic laminate composite materials, and the manner of making such composite materials, in accordance with the present invention will suggest themselves to a practitioner of the metallurgical and the metal working arts.

In accordance with the many possible variations and adaptations of the present invention, the scope of the invention should be determined in accordance with the following claims, only, and not solely in accordance with that embodiment within which the invention has been taught.

What is claimed is:

1. A composite laminate material consisting of a plurality of metal layers of one or more tough first metals or metal alloys; interleaved with a plurality of regions, coextensive with the metal layers, of hard intermetallic material consisting of (i) the one or more first metals or metal alloys reacted with (ii) one or more second metals or second metal alloys;

wherein the tough metal layers are separated by the hard intermetallic regions, and vice versa; and wherein reaction of the second metals or metal alloys with the first metals or metal alloys forms the hard intermetallic material in situ within the composite laminate material.

2. The composite laminate material according to claim 1 wherein the one or more tough first metals and metal alloys are drawn from the group consisting of titanium, nickel, vanadium and iron, and combinations of titanium, nickel, vanadium, and iron.

3. The material according to claim 1 wherein the one or more second metals or metal alloys are drawn from the group consisting of aluminum and alloys of aluminum.

4. The material according to claim 1 in a non-planar contour so as to improve penetration resistance.

5. The material according to claim 4 in corrugated form so as to improve penetration resistance.

6. A composite laminate material consisting of a plurality of metal layers selected from the group consisting of titanium, nickel, vanadium, and iron and alloys and combinations of titanium, nickel, vanadium, and iron; interleaved with a plurality of intermetallic regions, coextensive with the metal layers, selected from the group consisting of said tatanium, nickel, vanadium, and iron and alloys and combinations of titanium, nickel, vandium, and iron; reacted in situ with aluminum or alloys of aluminum;

wherein the intermetallic regions exist as boundaries between the metal layers, and vice versa;

wherein reaction of the (i) aluminum or alloys of aluminum with (ii) the titanium, nickel, vanadium, and iron and alloys and combinations of titanium, nickel, vanadium, and iron forms the hard intermetallic material in situ within the composite laminate material.

7. The composite laminate material according to claim 1 or claim 6 having residual internal stresses between the metal layers and the intermetallic regions.

8. The composite laminate material according to claim 1 or claim 6 used as armor.

9. The composite laminate material according to claim 1 or claim 6 wherein the metal layers are in a three-dimensional, non-planar, contour;

wherein the intermetallic regions are in a three-dimensional, non-planar, contour congruent with the contour of the metal layers;

wherein the composite laminate material is in a three-dimensional, non-planar, contour so as to improve penetration resistance.

10. The composite laminate material according to claim 1 or claim 6 wherein the metal layers are in a corrugated contour;

wherein the intermetallic regions are in a corrugated contour congruent with the contour of the metal layers;

wherein the composite laminate material is in a corrugated contour so as to improve penetration resistance.

11. The composite laminate material according to claim 1 or claim 6 wherein the metal layers have a toughness, in the state of the metals and metal alloys within the intermetallic regions, of greater than 40 MPa√ m.

12. The composite laminate material according to claim 1 or claim 6 wherein the regions of intermetallic material have a Vickers microhardness of greater than 400 kg/mm$^2$.

13. A composite laminate material consisting of a plurality of metal layers of one or more tough first metals or metal alloys; interleaved with a plurality of regions, coextensive with the metal layers, of hard intermetallic material consisting of the one or more first metals and metal alloys reacted in situ with one or more second metals or second metal alloys;

wherein the tough metal layers are separated by the regions of hard intermetallic material, and vice versa; and wherein the composite laminate material has a density between 3 and 4.5 grams per cubic centimeter.

14. A composite laminate material consisting of a plurality of metal layers of one or more tough first metals or metal alloys; interleaved with a plurality of regions, coextensive with the metal layers, of hard intermetallic material consisting of the one or more first metals and metal alloys reacted in situ with one or more second metals or second metal alloys;

wherein the tough metal layers are separated by the hard intermetallic regions, and vice versa; and wherein the composite laminate material has a density less than 6 grams per cubic centimeter.

15. A composite laminate material consisting of a plurality of metal layers of one or more tough first metals or metal alloys; interleaved with a plurality of regions, coextensive with the metal layers, of hard intermetallic material consisting of the one or more first metals and metal alloys reacted in situ with one or more second metals or second metal alloys;

wherein the tough metal layers are separated by the hard intermetallic regions;

wherein the metal layers are greater than 10 in number and larger than 100 cm$^2$ in area.

16. Armor comprising:

at least 10 metal layers, at least 100 cm$^2$ in area, of at least one tough first metal or metal alloy; separated by and interleaved with at least 9 hard intermetallic regions, coextensive with the metal layers and thus at least 100 cm$^2$ in area, of (i) the at least one tough first metal or metal alloy reacted in situ with (ii) at least one second metal or metal alloy;

in a laminate composite having the tough metal layers separated by the hard intermetallic regions that are formed in situ;

wherein reaction of the at least one second metal or metal alloy with the at least one first metal or metal alloy forms the hard intermetallic material in situ within the laminate composite.

17. The armor according to claim 16 wherein the at least one tough first metal or metal alloy is drawn from the group consisting of titanium, nickel, vanadium and iron, and combinations of titanium, nickel, vanadium, and iron.

18. The armor according to claim 16 wherein the at least one second metal or metal alloy is drawn from the group consisting of aluminum and alloys of aluminum.

19. Armor comprising:

at least 10 metal layers, at least 100 $cm^2$ in area, selected from the group consisting of titanium, nickel, vanadium, and iron and alloys and combinations of titanium, nickel, vanadium, and iron; interleaved with at least nine intermetallic regions, coextensive with the metal layers and thus at least 100 $cm^2$ in area, selected from the group consisting of said titanium, nickel, vanadium, and iron and alloys and combinations of titanium, nickel, vanadium, and iron; reacted in situ with aluminum or alloys of aluminum;

wherein said intermetallic regions exist as boundaries between the metal layers, and vice versa;

wherein reaction in situ of the (i) titanium, nickel, vanadium, and iron and alloys and combinations of titanium, nickel, vanadium, and iron with the (ii) aluminum or alloys of aluminum forms the intermetallic regions.

20. Armor according to claim 16 or claim 19 having a density between 3 and 4.5 grams per cubic centimeter.

21. Armor according to claim 16 or claim 19 having a density less that 6 grams per cubic centimeter.

22. Armor according to claim 16 or claim 19 having residual internal stresses between the metal layers and the intermetallic regions.

23. Armor according to claim 16 or claim 19 wherein the metal layers are in a three-dimensional, non-planar contour;

wherein the intermetallic regions are in a three-dimensional, non-planar, contour congruent with the contour of the metal layers;

whereby the armor is in a three-dimensional, non-planar, contour.

24. Armor according to claim 16 or claim 19 wherein the metal layers are in a corrugated contour; and wherein the intermetallic regions are in a corrugated contour congruent with the contour of the metal layers;

whereby the composite laminate material is in a corrugated contour.

25. Armor according to claim 16 or claim 19 wherein the metal layers have a toughness greater than 40 MPa√ m.

26. Armor according to claim 16 or claim 19 wherein the intermetallic regions have a Vickers microhardness of greater than 400 $kg/mm^2$.

27. Armor according to claim 16 or claim 19 wherein the metal layers are of differing thickness.

28. Armor according to claim 16 or claim 19 wherein the intermetallic regions are of differing thickness.

29. Armor according to claim 16 or claim 19 having such residual internal stresses between the metal layers and intermetallic regions as do serve to more substantially deflect a penetrating projectile from off its axis of impact than would be the case for the same penetrating projectile without the residual internal stresses.

* * * * *